United States Patent [19]

Gubler et al.

[11] 4,358,940

[45] Nov. 16, 1982

[54] PATTERN MECHANISM FOR A WARP KNITTING MACHINE

[75] Inventors: Hans Gubler, Seuzach; Otto Hintsch, Wallisellen, both of Switzerland

[73] Assignee: Sulzer Brothers Limited, Winterthur, Switzerland

[21] Appl. No.: 155,921

[22] Filed: Jun. 3, 1980

[30] Foreign Application Priority Data

Jun. 15, 1979 [CH] Switzerland ..... 5614/79

[51] Int. Cl.[3] ..... D04B 23/00

[52] U.S. Cl. ..... 66/207

[58] Field of Search ..... 66/203, 204, 231

[56] References Cited

U.S. PATENT DOCUMENTS 4,139,997 2/1979 Riesen ..... 66/207

*Primary Examiner*—Ronald Feldbaum

*Attorney, Agent, or Firm*—Kenyon & Kenyon

[57] ABSTRACT

The pattern mechanism for the warp knitting machine employs a reduction gear to change the shogging of the guide bar without changing the additive gearing. Elongated tension elements are disposed about the reduction gearing and have different parts secured to the reduction gear. The reduction gearing may be in the form of a multi-stepped roller or a roller having a periphery formed of curved portions of different radii.

10 Claims, 2 Drawing Figures

PATTERN MECHANISM FOR A WARP KNITTING MACHINE

Figure 1:
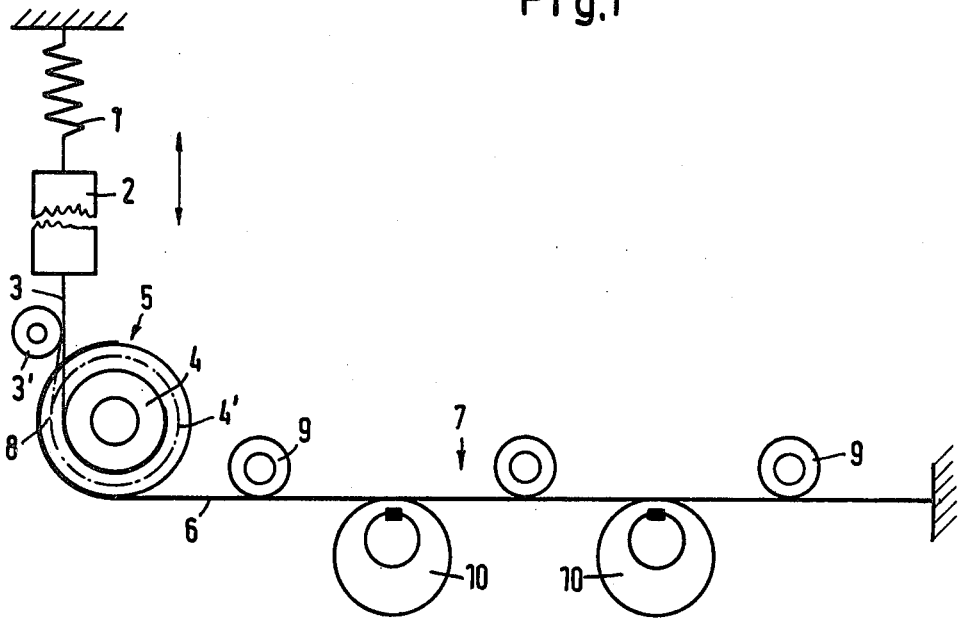

This invention relates to a pattern mechanism for a warp knitting machine.

Heretofore, it has been known to provide warp knitting machine with various types of pattern mechanisms, for example, for moving guide bars in a shogging direction. One known pattern mechanism for such a use includes final control elements which are connected to the guide bars via elongated tension elements. In this type of pattern mechanism, the stroke of a final control element or the cumulative strokes of a number of final control elements correspond to the shogging motion of the guide bars. Further, the stroke or the sum of the strokes correspond to the selected fineness of the needle spacing of the machine.

If the needle spacing of the machine is changed by replacing the needle bar, either the entire final control element system must be changed or the control elements must be adjustable. In the latter case, the control elements must be adjusted individually. However, this is a relatively tedious task. Further, the speed of the machine will be restricted if the final control elements produce the same stroke as the shogging stroke, particularly if there is a small spacing between the needles.

Accordingly, it is an object of the invention to avoid a complicated positioning and time consuming adjustment in the pattern mechanism for a warp knitting machine.

It is another object of the invention to obtain a high speed in a warp knitting machine with relatively small needle spacing.

Briefly, the invention provides a pattern mechanism for a guide bar of a warp knitting machine which is disposed for reciprocation in a shogging direction. The pattern mechanism includes a tension element connected at one end to the guide bar, at least one final control element disposed along an opposite end of the tension element for reciprocating the guide bar in the shogging direction and replaceable means for guiding the tension element thereon to change the shogging of the guide bar without changing the final control element.

The replaceable means for guiding the tension element may be in the form of a reduction gear which is exchangeable for other reduction gears having different fixed stepped-down ratios. Thus, if the needle spacing is changed, it is only necessary to change the stepped-down ratio, for example, by replacing the gear for another having a different fixed ratio. Alternatively, the stepped-down ratio can be changed by using change-gearing which can be changed stepwise or steplessly.

In one embodiment, the reduction gear is constructed as a multi-stepped roller. In this embodiment, the associated tension element has one part connected between one step of the roller and the guide bar and a second part connected to a second step of the roller for cooperation with the final control element. Advantageously, the stepped roller serves as a guide roller for the tension element.

In another embodiment, the reduction gear is formed as a roller having a periphery formed of curved portions with different radii. In this case, the tension element is guided around the roller with a first part running to and from a first portion of the roller and a second part running to and from a second portion of the roller of larger radius than the first portion for cooperation with the final control element.

By using a reduction gear in the above manner, the existing releatively large stroke of the final control elements of the pattern mechanism can be stepped down to the smaller stroke of the guide bars, particularly when there is a small needle spacing, thus increasing the speed.

In the case of warp knitting machines having a pattern mechanism made up of chain links which act via shogging levers on the guide bars, use has sometimes been made of a stepped-up gear by suitably forming the shogging lever. This has been done simply for the purpose of reducing the gradient at the chain links in order to reduce the resulting forces of acceleration. This known technique, however, is exclusively restricted to the use of pattern mechanisms in the form of chain links and cannot be applied to the final control elements of the "additive gearing" type. This is because there are no shogging levers available and since there is no need to reduce the gradient of any chain links.

Figure 2:
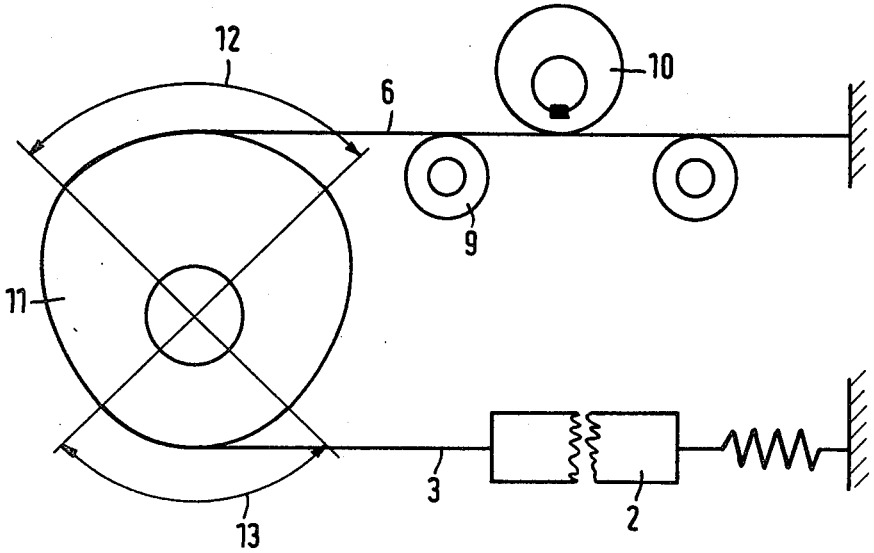

These and other objects and advantages of the invention will become more apparent when taken in conjunction with the following detailed description and appended claims in which:

FIG. 1 illustrates a diagrammatic plan view of a pattern mechanism constructed in accordance with the invention; and FIG. 2 illustrates a modified pattern mechanism according to the invention.

Referring to FIG. 1, the pattern mechanism for a warp knitting machine is constructed to move a multiplicity of guide bars 2, however only one pattern mechanism for one guide bar 2 is shown for simplicity. Each guide bar 2 is suitably formed to move pattern yarns in a known manner.

As shown, each guide bar 2 is disposed for reciprocation in a shogging direction as indicated by the arrow. To this end, one end of the guide bar 2 is secured to a spring which, in turn, is fixed to a fixed support in the warp knitting machine frame. The opposite end of the guide bar 2 is connected to a tension element of the pattern mechanism. As shown, the tension element, e.g. a belt has one part connected between the guide bar 2 and a small step 4 of a multi-stepped roller 5 while a second part 6 is connected between a larger step 8 of the roller 5 and a fixed abutment. In addition, an additive gearing 7 is disposed along the part 6. This gearing 7 includes guide rollers 9 for the tension element and eccentric deflection rollers 10 which act as control elements for deflecting the element about the guide rollers 9, for example, as described in German O.S. 26 10 888. As indicated, the tension element part 3 is guided around the smaller step 4 of the roller 5 such that the roller 5 acts as a guide roller.

The multi-step roller 5 acts as a reduction gear for guiding the tension elements 3, 6 thereon and has a given step-down ratio between the steps 4, 8. This step-down ratio can be changed by exchanging the step 4 for a larger step 4'. In this case, a roller 3' is used for straightening the part 3 on the tension element. By changing the steps, the amount of shogging of the guide bar 2 can be changed without changing the additive gearing 7.

Referring to FIG. 2, wherein like reference characters indicate like parts as above, the reduction gear may be in the form of a roller 11 having a periphery formed of curved portions 12, 13 having different radii from each other. As shown, the tension element is guided around the roller 11 in such a manner, that one part 3 of the tension element runs to and from the curved portion 12, while a second part 6 runs to and from curved portion 13. As the latter has a smaller radius than portion 12, there results a reduction of the stroke of the guide bar 2 relative to the stroke of the control element 10. It would also be possible to secure the tension elements 3, 6 on the roller 11 in a similar manner as shown in FIG. 1.

What is claimed is

1. A pattern mechanism for a guide bar of a warp knitting machine, said mechanism comprising a tension element for connection at one end to the guide bar;

at least one final control element disposed along an opposite end of said tension element for reciprocating the guide bar in a shogging direction; and a reduction gear guiding said tension element thereon for changing the shogging of the guide bar without changing said final control element.

2. A pattern mechanism as set forth in claim 1 wherein said reduction gear is exchangeable for other reduction gears having different fixed step-down ratioes.

3. A pattern mechanism as set forth in claim 2 wherein said reduction gear is a multi-step roller and said tension element has one part connected between one step of said roller and the guide bar and a second part connected to a second step of said roller for cooperation with said final control element.

4. A pattern mechanism as set forth in claim 2 wherein said roller guides said tension element thereon.

5. A pattern mechanism as set forth in claim 1 wherein said reduction gear is a roller having a periphery formed of curved portions having different radii, and said tension element has one end connected to the guide bar and is guided around said roller in such a manner that a part of said tension element connected to the guide bar runs to and from a first portion of said roller and another part of said tension element runs to and from a second portion of said roller of a larger radius than said first portion.

6. A pattern mechanism as set forth in claim 1 having a plurality of final control elements disposed along said opposite end of said tension element.

7. A pattern mechanism for a guide bar of a warp knitting machine, said mechanism comprising a tension element for connection at one end to the guide bar;

at least one final control element disposed along an opposite end of said tension element for reciprocating the guide bar in a shogging direction; and replaceable means for guiding said tension element thereon to change the shogging of the guide bar without changing said final control element.

8. A pattern mechanism as set forth in claim 7 wherein said means is a stepped roller and said tension element has one part connected between one step of said roller and the guide bar and a second part connected to a second step of said roller for cooperation with said final control element.

9. A pattern mechanism as set forth in claim 6 wherein said means is a roller having a periphery formed of curved portions having different radii, and said tension element has one part connected between the guide bar and one portion of said roller and a second part connected to a second portion of said roller of larger radius than said one portion for cooperation with said final control element.

10. A pattern mechanism as set forth in claim 7 having a plurality of said final control elements disposed along said opposite end of said tension element.

* * * * *